US006836980B2

(12) United States Patent
Woods

(10) Patent No.: US 6,836,980 B2
(45) Date of Patent: Jan. 4, 2005

(54) TOE GUARD ASSEMBLY AND METHOD

(76) Inventor: Tooley Verla Woods, 24936-11$^{th}$ Ave. So., Des Moines, WA (US) 98198

( * ) Notice: Subject to any disclaimer, the term of this patent is extended or adjusted under 35 U.S.C. 154(b) by 0 days.

(21) Appl. No.: 10/439,599

(22) Filed: May 16, 2003

(65) Prior Publication Data

US 2003/0213149 A1 Nov. 20, 2003

Related U.S. Application Data

(60) Provisional application No. 60/381,465, filed on May 17, 2002.

(51) Int. Cl.$^{7}$ ..... A43B 3/00

(52) U.S. Cl. ..... 36/110; 36/72 R

(58) Field of Search ..... 36/96, 97, 110, 36/7.2, 7.4, 7.7, 72 R, 77 R

(56) References Cited

U.S. PATENT DOCUMENTS

| | | | |
|---|---|---|---|
| 2,658,510 | A | 11/1953 | Hilton |
| 2,949,912 | A | 8/1960 | Shapiro |
| 3,487,830 | A | 1/1970 | Pruett |
| 3,643,659 | A | 2/1972 | Storer |
| 3,832,997 | A | 9/1974 | Cappelletti |
| 4,061,138 | A | 12/1977 | Bernstein |
| 4,103,438 | A | 8/1978 | Fron |
| 4,414,964 | A | 11/1983 | Farino et al. |
| 4,454,872 | A | 6/1984 | Brouhard |
| 4,566,208 | A | 1/1986 | Shaffner |
| D322,353 | S | 12/1991 | Bennett |
| 5,613,503 | A | 3/1997 | Penner |
| D391,744 | S | 3/1998 | McMaster |
| 5,878,511 | A | 3/1999 | Krajcir |

*Primary Examiner*—Ted Kavanaugh
(74) *Attorney, Agent, or Firm*—Polly L. Oliver

(57) ABSTRACT

The toe guard assembly is for use on a surgical boot which is open toed and has an inner sole. The parts of the assembly are the guard and a piece of double stick tape which attaches the guard to the inner sole. The guard has a cup-like toe portion which fits around the toes to be guarded, a sole tab which extends from the bottom of the toe portion over the inner sole, two side tabs, each of which extends from a side of the toe portion along the sides of the boot and an upper tab which extends from the top of the toe portion over the top of the boot. The side tabs may be detachably adhesively attached to the sides of the boot. One or more of the tabs may be a separate part attached to the toe portion. The guard may be a molded part, or have a molded toe portion with tabs attached or made from flat material in a pattern which, when folded, forms the guard.

3 Claims, 3 Drawing Sheets

TOE GUARD ASSEMBLY AND METHOD

RELATED APPLICATION

This application claims priority under 35 U.S.C. 119(e) to U.S. provisional application Ser. No. 60/381,465, filed on May 17, 2002.

FIELD OF THE INVENTION

The subject invention is in the field of apparatus and devices used to protect parts of the human body during athletic activities and work in hazardous conditions and to protect parts made vulnerable to pain from injuries and/or medical operations. In particular, it is in the field of devices used to protect toes which are so sensitive to pain or further injury that they cannot be protected by any conventional footwear, loose fitting or not.

BACKGROUND OF THE FIELD

There are many devices in this particular field, patented and not patented. For instance, U.S. Pat. No. 3,487,830 to Pruett and D391,744 to McMaster disclose toe caps for guarding injured and healing toes. However, these two devices use backstraps that are fastened around the wearer's ankle and therefore are rather cumbersome. Instead of a backstrap, U.S. Pat. No. 4,061,138 to Bernstein has a sole tongue to keep the toe cap in place. However, Bernstein's device has other more complicating features, such as an asymmetric shape—making it difficult to use with either foot. Brouhard's device in U.S. Pat. No. 4,454,872, has a flexible shape in the front of the toe cap, so that it can be used with either foot; however, the device has no sole tongue but is fastened in place with tied laces, rendering the device more difficult to install and remove.

None of the prior art apparatus or devices for protecting exposed toes is known to have been generally accepted and used. Foot surgeons continue to recognize a need for acceptable protection. As far as can be determined, the reasons for the lack of acceptance are subtle but influential. Prior art devices present one or more of the following problems: too cumbersome and therefore tending to increase chances of bumping; requiring too much precision and/or dexterity for proper installation; too confining and not sufficiently stable when installed.

Also, since the size and shape of the surgical boots with which these devices are used vary significantly, the devices are either made large enough to accommodate the largest expected size/shape combination of surgical boot or provided in a range of sizes. The large size is cumbersome and provision in a range of sizes is costly.

Accordingly, the objective of the subject invention is to provide, for exposed toes, a guard assembly which (1) is not cumbersome but provides adequate room for the toes; (2) requires minimal dexterity to install and use correctly; (3) is reliably stable when installed; and (4) has one size and shape accommodating a range of sizes and shapes of surgical boots.

SUMMARY OF THE INVENTION

After certain kinds of foot surgery, particularly surgery on toes, the patient cannot wear conventional footwear, sometimes for weeks, because of swelling and/or protrusion of wires or rods used to hold bone segments in proper alignment until enough healing has taken place. Contact between the toes and/or rods is very painful. Therefore, the patient wears what is termed a surgical boot. Such a boot is open-toed, has a firm but well padded sole and soft, padded, flexible uppers which fold across the top of the foot, well away from the toes, and lap over, being fastened in place by, for example, a VELCRO™ fastening.

The present invention is made of thin, stiff plastic, preferably clear, and comprises a cup, an upper tab, a sole tab and two side tabs extending from the cup. The cup surrounds the toes partially or entirely with ample clearance around the toes and any protuberances. It is important to the present invention that there be not only ample clearance, but also ample air circulation around the toes once the device is installed. For that reason, the toe cap is not a solid piece, but is shortened and is designed with side tabs extending rearward from the toe cap providing much open space for air to enter and exit the device.

The sole tongue extends from the lower portion of the toe cup into the surgical boot along the upper surface of the sole, i.e., the inner sole. The side tabs extend one on each side of the surgical boot and the upper tab extends over the boot. The guard is held in place against the sole by double stick tape. It has been determined that a double stick tape marketed by W. H. Collins, Inc., Spartanburg, S.C. 29304 and sold as Res. Q Tape™ is well adapted to the purposes of the subject invention. The preferred tape width is ¾ inch and the tape leaves no residue. The guard may be made without the upper tab.

The guard may be molded in one piece (so that several guards may be nested together) or may comprise a cup with tabs attached. Also, it may be made in one flat piece which is folded and fastened when ready for use or it may comprise more than one flat piece with sections folded, fastened and attached as required, possibly using single stick and/or double stick tape for assembly and fastening. The flat pieces may be embossed to facilitate accurate folding.

The invention is described in more detail below with reference to the attached drawings.

DETAILED DESCRIPTION OF THE INVENTION

Figure 1:
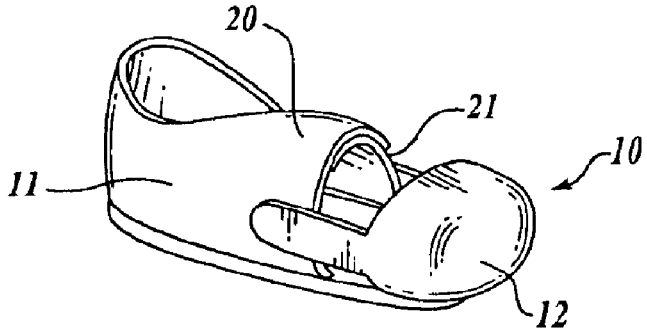
FIG. 1 illustrates one embodiment of the invention installed on a surgical boot.

The subject invention is a toe guard assembly for use on a surgical boot. FIG. 1 illustrates one embodiment of guard assembly 10 (including a toe guard and means for attaching)

installed on a surgical boot 11. Portion 12 of the toe guard is termed the cup portion, surrounding the toes (not shown) being guarded.

Figure 2:
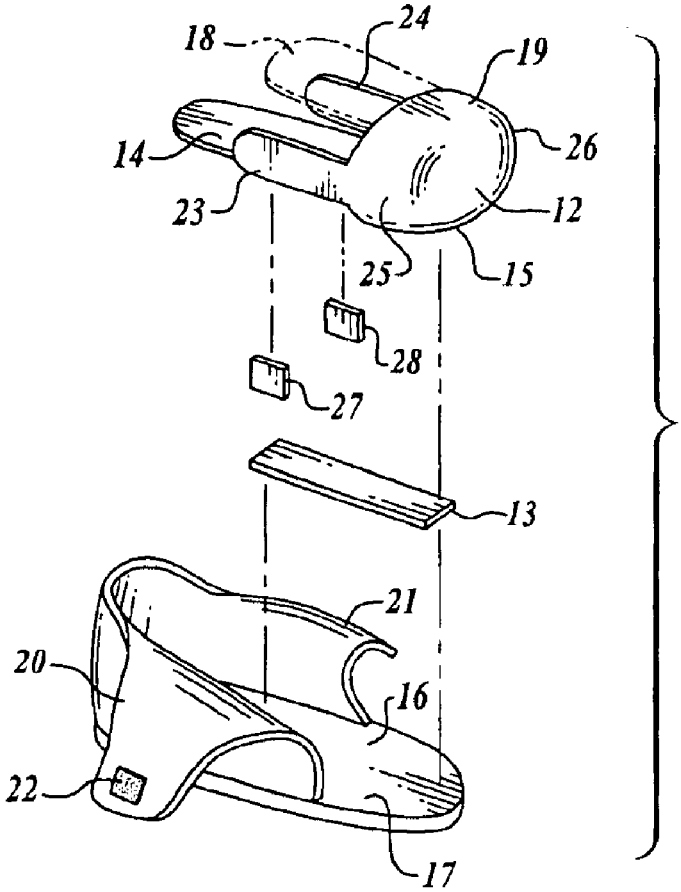
FIG. 2 is an exploded view of the components shown in FIG. 1 plus the tape which holds it in place on the boot.

FIG. 2 is an exploded view of the components shown in FIG. 1 plus a piece of double stick tape 13 which holds the toe guard 10 in place in the boot 11. The guard 10 in this embodiment is a molded part and comprises the cup portion 12 and sole tab 14 which extends from the lower portion (bottom) 15 of the cup 12. In the preferred embodiment, the upper portion (top) 19 of the cup 12 is slightly larger than the lower portion 15 so as to provide ample interior room for the toes and for air circulation.

The tape 13 is used to detachably attach the sole tab 14 to the surface 16 of inner sole 17 of the boot 11. This embodiment of the guard 10 may include a second, upper tab 18, shown in phantom lines. The upper tab 18 extends from the upper portion 19 of the cup portion 12 and extends over the top of a foot (not shown) in the boot 11 and over or under the sides 20 and 21 of the boot 11 which are folded over the foot and fastened with hook and loop fastenings such as VELCRO™, one piece 22 of which is shown on side 20.

The thickness of the material from which the guard is constructed in all embodiments is in a range of 1/64 of an inch to 1/8 of an inch, with 1/32 of an inch preferred. The sole tab 14 may extend in a range of 1/4 of the length of the boot sole 17 to the full length, with 1/2 of the length preferred. Still referring to FIG. 2, the guard 10 also comprises first and second side tabs 23 and 24, extending from sides 25 and 26 of the cup portion 12. The side tabs 23, 24 may be attached to the boot 11 by double stick tape pieces 27 and 28.

In alternate embodiments, nylon tape may be used to reinforce the high stress points on the assembled guard, such as the seams (edges between portions) and the corners of the assembly. Also, in alternate embodiments of this invention, the side tabs may be separate pieces attached to the cup portion 12, e.g., by adhesive.

Figure 3A:
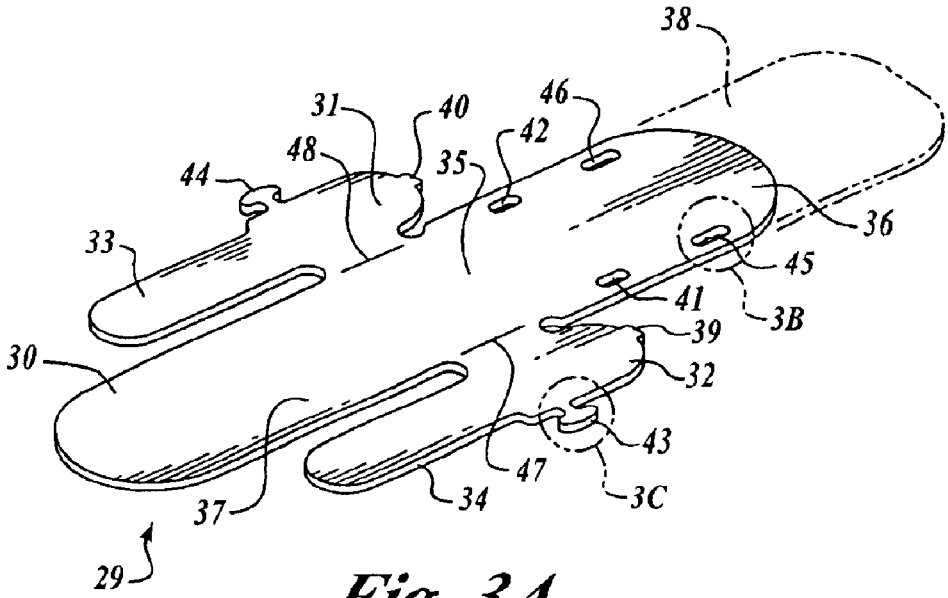
FIG. 3A illustrates the flat pattern of an alternate embodiment of the subject guard which is made of flat material.
Figure 3B:
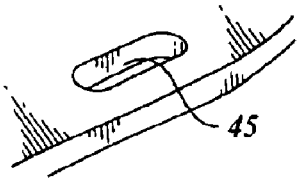
FIG. 3B is a detail view of one of the edge slots of FIG. 3A.
Figure 3C:
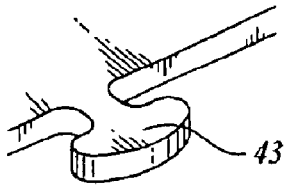
FIG. 3C is a detail view of one of the T-tabs of FIG. 3A.
Figure 4:
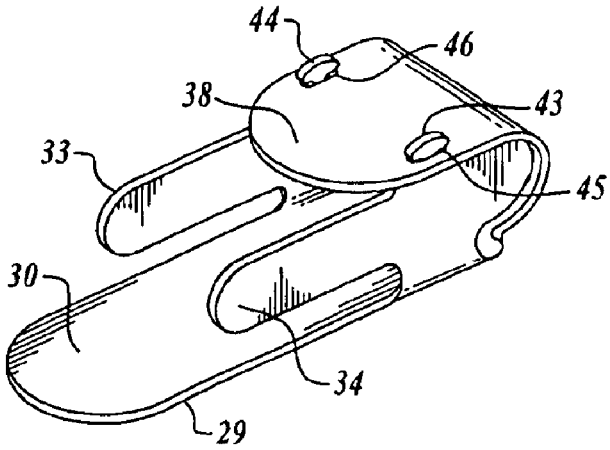
FIG. 4 illustrates the embodiment shown in FIG. 3A ready for use.

FIG. 3A illustrates the flat pattern of an alternate embodiment of the subject guard 29 which is made of a one-piece flat material. Portion 30 is the sole tab; portions 31 and 32 are the side portions including side tabs 33 and 34. When folded over a foot, portion 35 becomes the cup portion and 36 is the top portion thereof, and 37 is the bottom portion thereof along with optional upper tab 38. This flat material is fashioned into a toe guard by folding the side portions 31, 32 upward and then folding portion 35 around the toes so that protrusions 39 and 40 on the side portions 32 and 31 engage slots 41 and 42, and T-tabs 43 and 44 can be inserted into slots 45 and 46 to hold the part in the folded configuration as shown in FIG. 4. Embossed lines 47 and 48 enable the sides 32 and 31 to be sharply bent with respect to portion 37. The smaller circled views shown in FIGS. 3B and 3C illustrate T-tabs 43 (and 44) and slots 45 (and 46) in more detail.

Figure 5A:
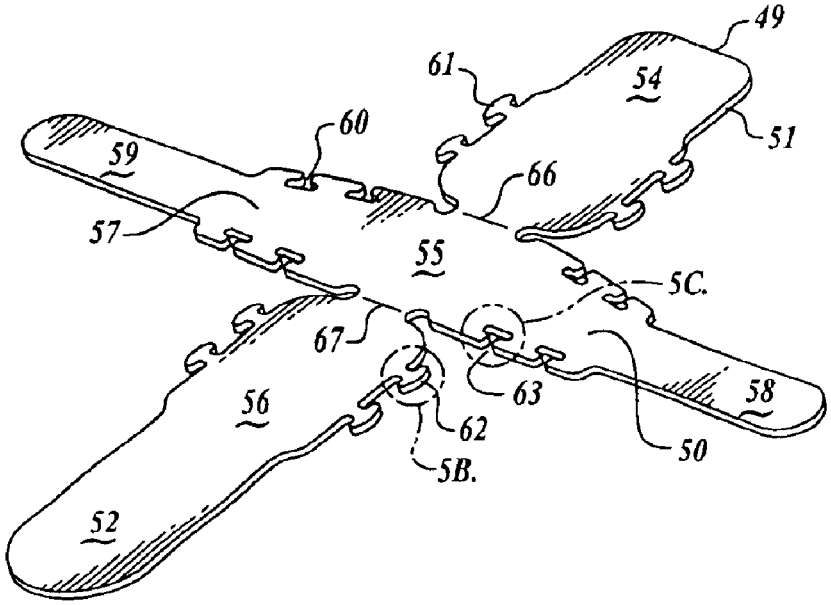
FIG. 5A illustrates the flat pattern of a second alternate embodiment made from flat material.
Figure 5B:
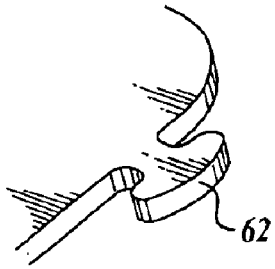
FIG. 5B is a detail view of one of the edge T-tabs of FIG. 5A.
Figure 5C:
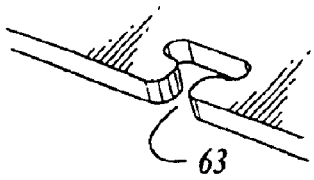
FIG. 5C is a detail view of one of the edge notches of FIG. 5A.

FIG. 5A illustrates the flat pattern 49 of another alternate embodiment made from a one-piece flat material. The flat material is cut roughly in the shape of a cross having a geometric center with four lobes. Portion (or lobe) 52 is the sole tab, and portion 56 becomes the bottom of the cup. Portion 54 becomes the top of the cup with portion (or lobe) 51 being the optional upper tab. Portion 55 becomes the front of the cup, and portions 50 and 57 are the sides of the cup with portions (or lobes) 58 and 59 being the first and second side tabs. Edges of the cup forming portions, edges 60 and 61 being typical, are configured to interlock. Interlock features 62 and 63 are enlarged and shown in detail in the circled views of FIGS. 5B and 5C, e.g., tab 62 snaps into notch 63. (The figure shows two such interlocks at each edge. However, there could be only one interlock per edge. Likewise there could be three or more.) As shown in FIG. 5A, the lobes defining the first and second side tabs can be widened towards the geometric center so that upon folded assembly, the top of the cup will provide more toe room.

Embossed lines 66 and 67 may be used to facilitate folding. The material is folded so that the top and bottom of the cup engage the sides of the cup.

Figure 6:
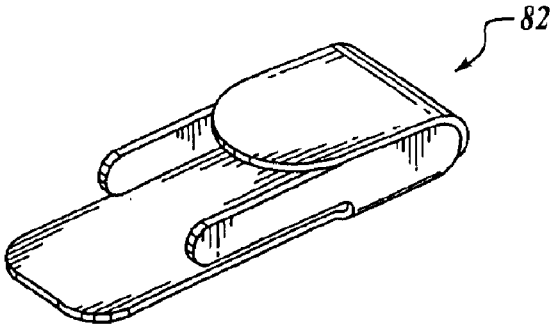
FIG. 6 illustrates an alternate embodiment of the guard similar to the one shown in FIGS. 3A and 4 but made of thermoplastic material.

FIG. 6 illustrates another alternate embodiment of the guard 82 similar to the one shown in FIGS. 3 and 4 but made of thermoplastic material which is heated, shaped over a form and allowed to cool.

All embodiments are preferably made of transparent material.

It is considered to be understandable from this disclosure that the subject invention meets its objectives. It provides, for exposed toes, a guard which (1) is not cumbersome but provides adequate room for the toes, (2) requires minimal dexterity to install and use correctly, (3) is reliably stable when installed and can accommodate a range of sizes and shapes of surgical boots, using the sole, upper and side tabs.

It is also considered to be understood that while certain embodiments of the invention have been disclosed, other embodiments and modifications of those disclosed are possible within the scope of the invention which is limited only by the attached claims.

I claim:

1. A guard assembly for toes, for use with a surgical boot having an inner sole and first and second boot sides, said guard assembly comprising:

a guard comprising a cup, a sole tab, and first and second side tabs; said cup having a top, a bottom, and first and second sides, said sole tab being integral with and extending generally rearwardly from said bottom, said first side tab being integral with and extending generally rearwardly from said first side, and said second side tab being integral with and extending generally rearwardly from said second side, such that when said guard assembly is attached to said boot said sole tab lies on said inner sole and said side tabs extend rearwardly along said boot sides;

an upper tab being integral with and extending generally rearwardly from said top and extending rearwardly over said boot when said guard assembly is installed on said boot; and double-stick tape for attaching said guard to said boot.

2. The guard assembly of claim 1 wherein the cup top is enlarged relative to the cup bottom providing ample room for the toes when installed on a surgical boot.

3. The guard assembly of claim 1 wherein the sole tab is dimensioned to extend 1/2 the entire length of the boot inner sole.

* * * * *